United States Patent [19]

Spademan

[11] Patent Number: 4,492,387

[45] **Date of Patent: * Jan. 8, 1985**

[54] STEP-IN SIDE-CLAMP SAFETY SKI RELEASE SYSTEM

[76] Inventor: Richard G. Spademan, 1421 Old Country Rd., Belmont, Calif. 94002

[ * ] Notice: The portion of the term of this patent subsequent to Oct. 5, 1999 has been disclaimed.

[21] Appl. No.: 370,028

[22] Filed: Apr. 20, 1982

Related U.S. Application Data

[63] Continuation of Ser. No. 109,807, Jan. 7, 1980, abandoned.

[51] Int. Cl.[3] ..... A63C 9/085

[52] U.S. Cl. ..... 280/624

[58] Field of Search ..... 280/624, 625, 636, 632, 280/611, 631, 605, 623

[56] References Cited

U.S. PATENT DOCUMENTS

| | | | |
|---|---|---|---|
| 2,997,309 | 8/1961 | Van Natter | 280/605 |
| 3,606,370 | 9/1971 | Spademan | 280/624 |
| 3,891,227 | 6/1975 | Spademan | 280/624 |
| 4,063,752 | 12/1977 | Whitaker | 280/624 |
| 4,070,034 | 1/1978 | Swenson | 280/625 |
| 4,143,886 | 3/1979 | Saloman | 280/624 |
| 4,145,071 | 3/1979 | Saloman | 280/624 |
| 4,352,508 | 10/1982 | Spademan | 280/624 |

FOREIGN PATENT DOCUMENTS

| | | | |
|---|---|---|---|
| 2456326 | 8/1976 | Fed. Rep. of Germany | 280/631 |

*Primary Examiner*—David M. Mitchell

*Attorney, Agent, or Firm*—Townsend and Townsend

[57] ABSTRACT

A step-in side-clamp safety ski release system includes an over-center mechanism having a lever member pivotally coupled intermediate its ends to a connecting member. When the lever member is pivoted in a first direction, it slidably engages a housing for moving the lever member and connecting member against a spring force for opening a pair of side-clamping members. Pivoting of the lever member in an opposite direction disengages the lever member from the housing, permitting the lever member and connecting member to move with the spring force for closing the side-clamp members. A means for receiving the tip of a ski pole is provided to pivot the lever member in a first direction to open the clamping members; means are also provided for receiving the heel of a ski boot to pivot the lever member in a second direction to close the clamping members.

11 Claims, 13 Drawing Figures

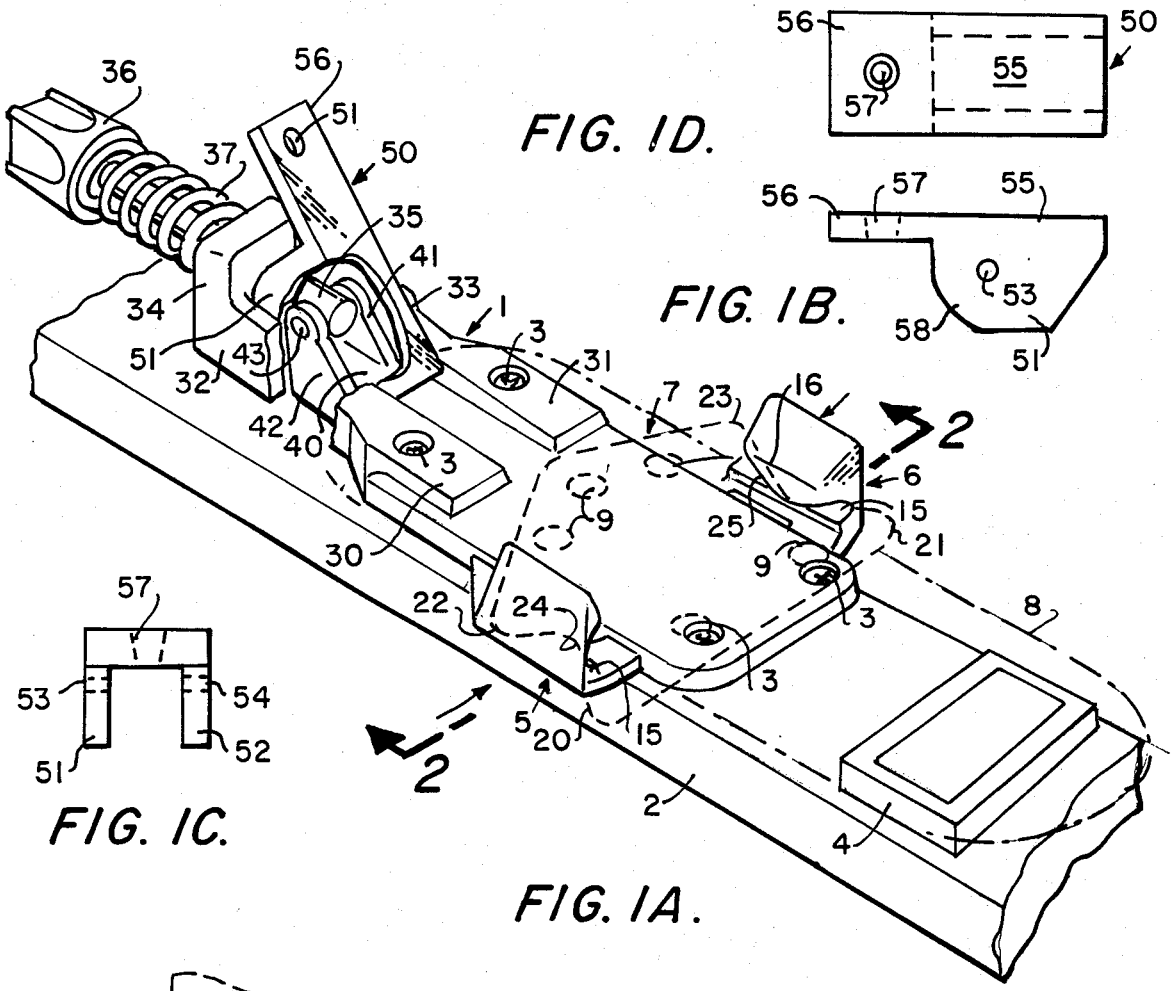
FIG. 1A.
FIG. 1D.
FIG. 1B.
FIG. 1C.
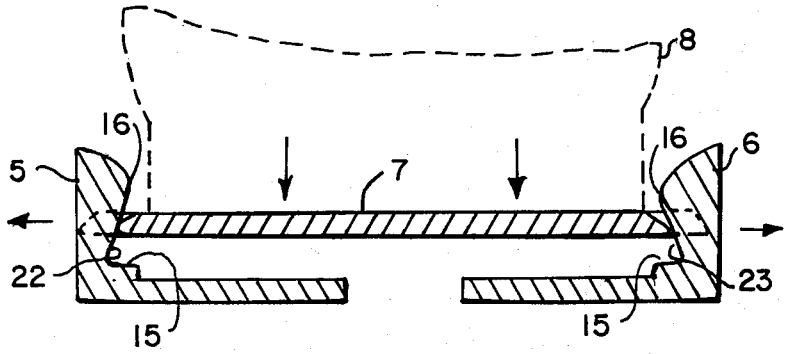
FIG. 2A.
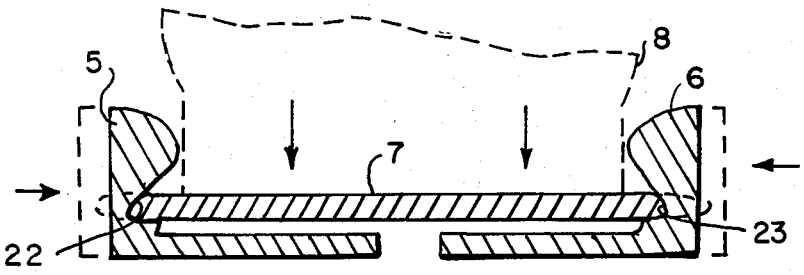
FIG. 2B.

STEP-IN SIDE-CLAMP SAFETY SKI RELEASE SYSTEM

This is a continuation of application Serial No. 109,807 filed Jan. 7, 1980 now abandoned.

BACKGROUND OF THE INVENTION

The present invention relates to ski release bindings in general and in particular to the Spademan safety release systems shown and described in U.S. Pat. No. 3,606,370 and U.S. Pat. No. 3,891,227.

In each of the patents referred to there is disclosed and described a ski release system comprising a housing, a pair of side-clamping members which are movable relative to the housing in opposite directions generally perpendicular to the lateral edges thereof, a connecting member or other means which is movably coupled to the side-clamping members for moving the side-clamping members, and a resilient member in an overcenter release mechanism coupled to the connecting member for applying a spring force to the side-clamping members through the connecting member. For use in cooperation with the side-clamping members, there is also provided a separable plate or similar device for releasably binding a ski boot and a ski.

Depending on the embodiment, the movable side-clamping members are mounted on a ski, and the plate member is mounted on the bottom of a ski boot between the ball of the foot and heel thereof, as shown in the above U.S. Patents 26,972 and 3,606,370. Alternatively, the movable side-clamping members comprising plate-like members having an exterior contour like the plate member in the above patent U.S. Pat. No. 3,606,370 are mountedto or in the bottom of a ski boot and the plate or similar apparatus in the form of fixed jaw-like members is mounted on a ski, as shown in U.S. Pat. No. 3,891,227.

To open and close the side-clamping members relative to the plate in the above described patented bindings, it is necessary to move the overcenter release mechanism by hand. For example, to open the side-clamping members, it is necessary to move the overcenter mechanism by hand from a horizontal position in which it is applying a spring force to the side-clamping members for holding the clamping members in a clamping position, pivotably upwardly for releasing the spring tension on the connecting member and side-clamping members so as to permit the side-clamping members to spread for receiving or releasing the plate member from therebetween. Conversely, to enter the binding, the plate member is placed between the side-clamping members, and the overcenter release mechanism is pivoted from its vertical or raised position downwardly to a position substantially horizontal to the ski for applying the spring force to the connecting member and side clamping members.

In practice, the operation of the overcenter release mechanism to enter and leave the binding has been found to be inconvenient and often difficult. This is because a skier must either bend over and manually grasp the overcenter release mechanism or use a ski pole tip to move the mechanism. With regard to the latter practice, depending on the angular position of the tension-adjusting knob at the end of the overcenter release mechanism, it is frequently difficult to insert the tip of a ski pole thereagainst without having the ski pole tip slide therefrom. Bending over and grasping the overcenter release mechanism by hand is difficult, especially if a skier is wearing bulky clothes. This type of operation is also inconvenient and difficult because a skier must bend over or use a ski pole tip to activate the mechanism while attempting to retain the position of the plate member between the side-clamping members. If the ski slope is steep or irregular, the snow conditions deep or slippery, the skier often must frustratingly repeat the operation several times before successfully engaging the boot plate in the clamping members.

For these reasons, it is desirable to be able to simply step into the binding to enter the binding and to have a simpler means for stepping out of the binding than has been heretofore possible.

SUMMARY OF THE INVENTION

In view of the foregoing, a principal object of the present invention is a step-in safety ski release system in general, and in particular a step-in side-clamping safety ski release system retaining all of the advantages of the previously patented Spademan safety ski release systems shown and described in U.S. Pat. No. Re. 26,972, U.S. Pat. No. 3,606,370 and U.S. Pat. No. 3,891,227.

In accordance with the above object, there is provided in each of several embodiments disclosed herein an overcenter lever mechanism which is separate and apart from a resilient member used for applying a spring force to a pair of side-clamping members. The overcenter lever mechanism as disclosed is pivotably coupled and suitably positioned for moving a connecting member coupled to the side-clamping members for moving the side-clamping members between open and closed positions. In some embodiments, the connecting member is moved rearwardly by a lever member in the overcenter mechanism to open the side-clamping members. In other embodiments, it is moved forwardly to open the side-clamping members. In some embodiments, the lever member in the overcenter lever mechanism is provided for opening and closing movable side-clamping members are mounted on or in the sole of a ski boot.

In use, all of the embodiments described permit a skier to step in and step out of the binding without bending over to manipulate a mechanism by hand.

DESCRIPTION OF THE DRAWINGS

The above and other objects, features and advantages of the present invention will become apparent from the following detailed description of the accompanying drawings in which:

FIG. 1A is a perspective view of one embodiment of the present invention.

FIG. 1B is a side view of a lever member according to the present invention.

FIG. 1C is an end view of the FIG. 1B.

FIG. 1D is a plan view of FIG. 1B.

FIG. 2A is a tranverse cross-sectional view of a plate member and side clamping members according to the present invention with the side clamping members in an open position and the plate member partially inserted therebetween.

FIG. 2B is a transverse cross-sectional view of the side clamping members and plate member showing the side clamping members in a closed position with the plate member centered therebetween.

DETAILED DESCRIPTION

Figure 3:
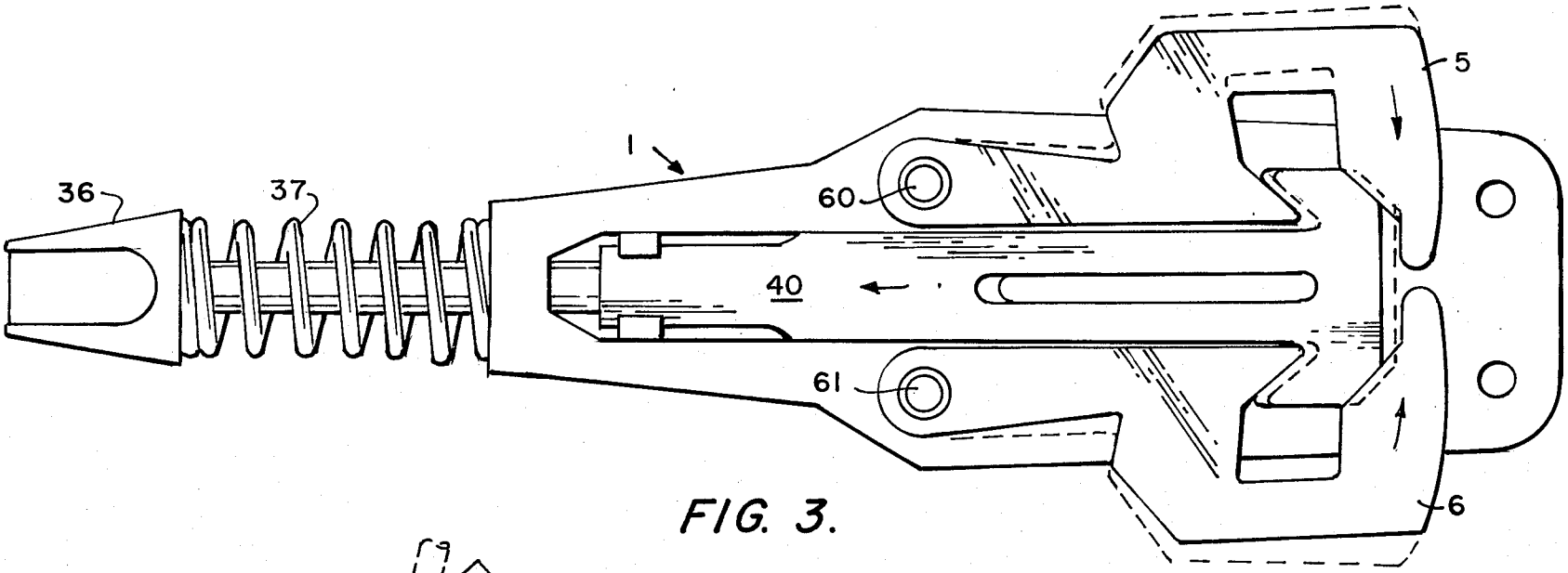
FIG. 3 is a bottom view of the binding of FIG. 1.

Referring to FIGS. 1–4, there is provided in a first embodiment of a step-in safety side-clamping ski release system according to the present invention, a housing designated generally as 1, removably mounted on a ski 2 as by a plurality of screws or the like 3. Also mounted to the ski 2, forward of the housing 1, is a conventional toeplate 4. Toeplate 4 forms no part of the present invention and accordingly is not further described. At the forward end of the housing 1 there is provided a pair of side-clamping members 5 and 6. Shown in broken lines between the side-clamping members 5 and 6, is a plate member 7. The plate member 7 is mounted on the under surface of the sole of a ski boot, also shown in broken lines designated 8 by means of screws or the like in a plurality of holes 9.

Each of the side-clamping members 5 and 6 comprises a shoulder portion 15 for supporting the plate member 7. Immediately above the shoulder 15 and spaced slightly therefrom is an inwardly extended overlying protuberance 16. The protuberance 16 overlies the plate 7 for preventing its slipping from between the clamping members 5 and 6 when they are in their closed position.

Along its lateral edges, which are beveled inwardly from its bottom or ski side toward its upper surface, the plate member 7 comprises a pair of forward tip members 20 and 21 and a pair of rearward tip members 22 and 23, each of which is separated by a recess or indentation 24 and 25, respectively. The particular contour of the clamping members 5 and 6 and the contour of the plate member 7, particularly the tip members 20, 21, 22, 23 and the indentations 24 and 25, along the beveled lateral edges thereof are provided for permitting release, as more fully described in the above patents.

Rearward of the clamping members 5 and 6, at the rear of the housing 1, there is provided a pair of spaced heel-step members 30 and 31 for supporting the heel of the boot 8. Rearward of the heel-step members 30 and 31, the housing 1 is formed with a pair of spaced wall members 32 and 33. The wall members 32 and 33 are terminated by an upstanding rear wall member 34. Extending through the wall member 34, is a rod or shaft member 35. The rod or shaft member 35 extends rearwardly of the wall 34 and is terminated by an internally threaded spring-adjusting knob 36 for adjusting the compression applied to a spring 37 disposed about the rod 35 between the knob 36 and the rear of the wall 34.

Provided in housing 1 for moving the clamping members 5 and 6, and shown between the heel-step members 30 and 31 in FIG. 1, is a connecting member 40, as will be described in more detail below. Connecting member 40 has a pair of upstanding members 41 and 42. The interior end of the rod member 35 is coupled, by means of a pin 43, to the upstanding members 41 and 42.

As described thus far, the ski release binding of FIG. 1 is substantially identical to the binding described in the above referenced United States patents issued to applicant except that in the apparatus of FIG. 1 the mechanism comprising the adjusting knob 36, spring 37 and rod 35 is not free to pivot relative to the upstanding members 41 and 42, as described in the prior patents.

Pivotably mounted between the upstanding walls 32 and 33 at the rear of the housing 1 there is provided a lever member designated generally as 50. The lever member 50 is pivotably mounted to the connecting member 40 by means of the pin 43 connecting the rod 35 to the upstanding members 41 and 42 of the connecting member 40.

Referring to FIGS. 1B, 1C and 1D, there is provided in the lever member 50 a pair of spaced leg members 51 and 52. In the leg members 51 and 52 there is provided, respectively, a hole 53 and 54 for receiving the pin 43 for pivotably mounting the lever member 50 to the upstanding members 41 and 42 of the connecting member 40. The surface of the member 50 opposite the leg members 51 and 52 comprises a generally flat surface 55. Depending from the rear of the lever member 50 there is provided a rearwardly extending overhanging member 56. In the overhanging member 56 there is provided a beveled hole 57 for receiving the tip of a ski pole or the like (not shown). The rear surface of the downwardly depending leg members 51 and 52 are curved and contoured as at 58 for slidably engaging the interior surface of the upstanding wall member 34 of the housing 1 when the overhanging member 56 is depressed for pivoting the lever member 50, as will be described in further detail below with respect to FIGS. 3 and 4.

Figure 4:
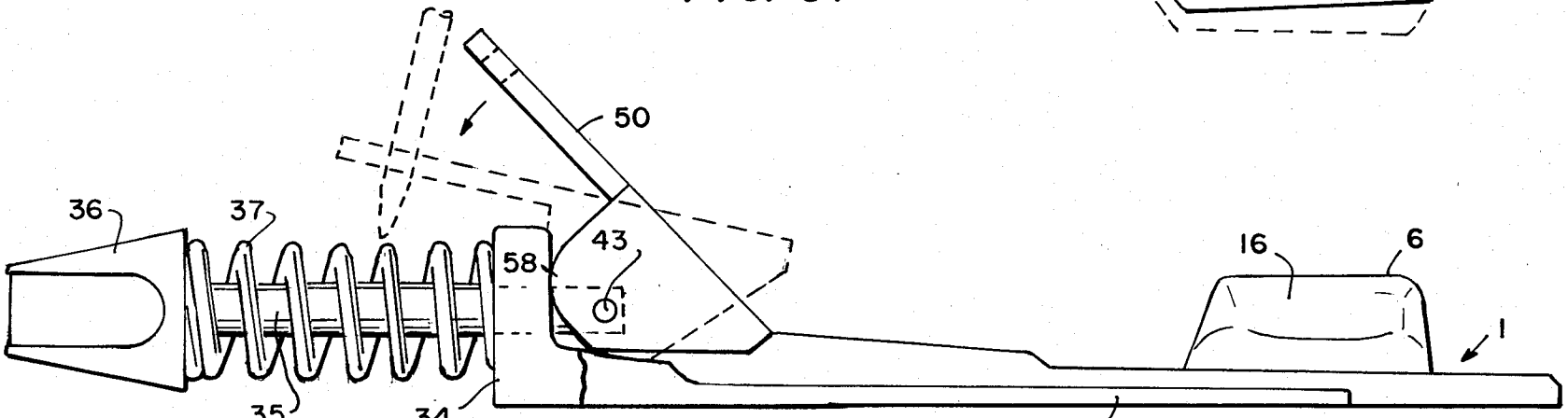
FIG. 4 is a partial side view of the binding of FIG. 3 showing the relationship of the overcenter step-in mechanism and the connecting member and one of the side clamping members of FIG. 3.

Referring to FIGS. 3 and 4, the side-clamping members 5 and 6 are pivotably connected to the housing 1 by means of pivot members 60 and 61 such that the clamping members 5 and 6 move generally perpendicular to the lateral edges of the housing 1 as the connecting member 40 is moved parallel to the longitudinal axis of the housing 1. As shown in FIG. 4, with the lever member 50 in its raised position, as shown in solid lines, the spring member 37 cooperates with the adjusting knob 36 and rod member 35 to pull the connecting member 40 rearwardly in the direction of the arrow, as shown in FIG. 3. The rearward movement of the connecting member 40 causes the T-shaped end of the connecting member 40 to slidably engage corresponding parts of the clamping members 5 and 6, pulling the members 5 and 6 inwardly to a closed clamping position.

To open the clamping members 5 and 6, in preparation for the insertion of the plate 7 therebetween, the lever member 50 is pivoted as by the tip of a ski pole or the like to a more horizontal position, as shown in broken lines in FIG. 4. The pivoting of the lever member 50 to the horizontal position shown in broken lines in FIG. 4, causes the rear surface 58 of the downwardly depending leg members 51 and 52 of the lever member 50 to slidably contact the interior surface of the rear upstanding wall 34. As the surface 58 contacts the interior surface of the wall 34 and the lever member 50 is further pivoted in the directionj of the arrow, the lower member 50 causes the connecting member 40 to be pushed forwardly against the spring force of the spring 37. The forward movement of the connecting member 40 causes the forward end of the connecting member 40 to slidably contact and spread apart the clamping members 5 and 6.

From the foregoing it is apparent that to step into the binding, the clamping member 50 is initially placed in a horizontal position shown in broken lines in FIG. 4. This causess the clamping members 5 and 6 to be in the open position of the broken lines shown in FIGS. 2A and 3. Thereafter, as a skier steps into the binding and brings his heal down upon the upper forward surface of the clamping member 50, the clamping member 50 will be pivoted about the axis of the pin 43. As the rear surface 58 of the clamping member 50 clears the wall 34, the spring 37 will draw the connecting member 40 rearwardly causing the clamping members 5 and 6 to move inwardly, releasably clamping the plate 7 and ski boot attached thereto to the ski. As described above, the procedure is reversed to open the clamping members 5 and 6.

Figure 5:
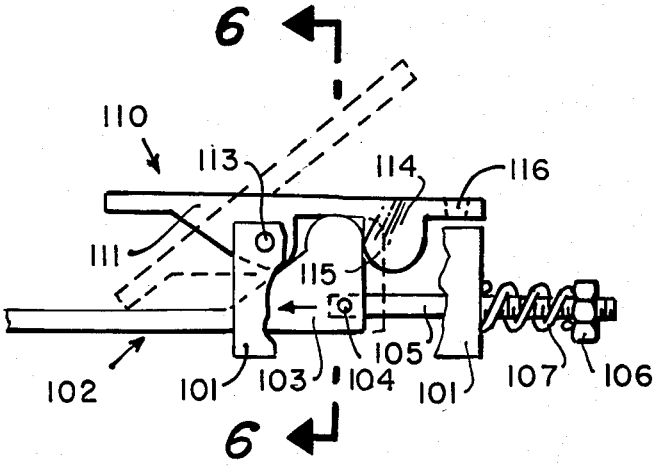
FIG. 5 is a schematic representation of an alternative embodiment of a binding according to the present invention.
Figure 6:
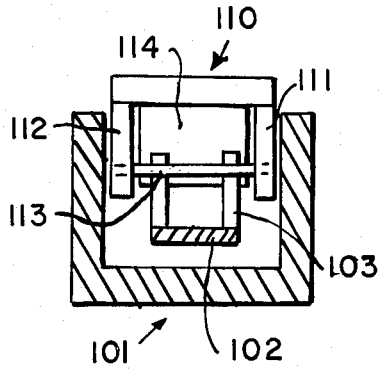
FIG. 6 is a front transverse cross-sectional view of FIG. 5.

Referring to FIGS. 5 and 6, there is shown in a schematic representation of an alternative embodiment of the present invention, a housing 101. The housing 101 is provided for housing a pair of side-clamping members (not shown) such as described above with respect to FIGS. 1–4, and a connecting member 102. The connecting member 102 has a pair of upstanding members 103. Connected to the connecting member 102, as by a pin 104, there is provided, extending rearwardly therefrom, a rod member 105. The rod member 105 passes through a bore provided therefor in the rear of the housing 101 and is terminated by a spring-adjusting knob 106 for adjusting the compression applied to a spring member 107 coaxially supported on the rod 105 between the rear of the housing 101 and the interior surface of the knob 106.

Above the connecting member 102, as shown in FIG. 3, there is provided a lever member designated generally at 110. The lever member 110 is provided with two downwardly extending side wall members 111 and 112. The side wall members 111 and 112 are pivotably secured to the housing 101 as by a pin member 113. To the rear of the downwardly depending wall members 111 and 112 there is provided a downwardly extending member 114 having a forward and bottom curved surface 115 for slidable engagement with the upper rear surface of the upstanding members 103 of the connecting member 102. Rearward of the downwardly depending member 114, the lever member 110 is further provided with a beveled hole 116 for receiving the tip of a ski pole or the like for pivoting the lever member 110 about the axis of the pin 113. As described above with respect to the lever member 50 of the embodiment of FIGS. 1–4, the lever member 110 is provided with a relatively flat upper surface at its forward end for receiving the heel of a ski boot for pivoting the lever member 110 in an opposite direction about the axis of the pin 113.

In operation, with the lever member 110 in the position shown in dashed lines in FIG. 5, the spring force from the spring 107 draws the connecting member 102 rearwardly for closing the side clamping members (not shown) as described above with respect to the embodiment of FIGS. 1–4. When the lever member 110 is pivoted about the axis of the pin 113, as by a ski pole tip inserted in the hole 116, the curved surface 115 is caused to slidably contact a corresponding surface of the upstanding members 103 of the connecting member 102. As the lver member 110 is further pivoted, the downwardly depending member 114 causes the connecting member 102 to be pushed forwardly against the force of the spring 107. The forward movement of the connecting member 102 causes the side clamping members to open for permitting removal of a boot and plate assembly therefrom.

With the clamping members thus held in an open position, the operation of the lever member 110 can be reversed for closing the side clamping members. To do this, a skier steps into the binding and presses down on the forward upper surface of the lever member 110 to pivot the forward end of the lever member 110 downwardly about the axis of the pin 113. As the lever member 110 is pivoted in this fashion, the downwardly depending member 114 is raised. When the member 114 clears the rear surface of the upstanding members 103, the spring 107 will draw the connecting member 102 rearwardly closing the clamping members, as described above with respect to the rearward motion of the connecting member 40 with respect to FIGS. 1–4.

Figure 7:
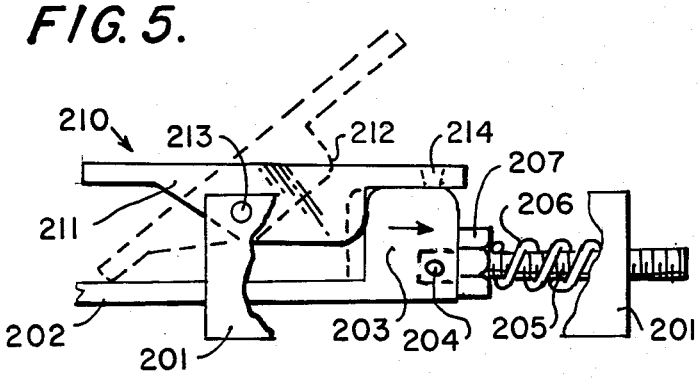
FIG. 7 is a schematic view of another embodiment of the present invention.

Referring to FIG. 7, there is provided, in another embodiment of the present invention, a housing 201. As described above with respect the embodiment of FIG. 5, only a fragmentary portion of the housing 201 is shown in the figure for clarity. Forward of the right end of the housing 201 there is provided a connecting member 202. At the rear end of the connecting member 202, there is an upstanding wall member 203. Connected to the wall member 203, as by a pin 204, there is provided a rod member 205. Coaxially mounted on the rod member 205 is a spring member 206. Spring member 206 is mounted between the rear of the wall member 204 and the interior of the housing 201 so as to provide a spring force tending to push the connecting member 202 forwardly relative to the housing 201. To the rear of the housing 201, there is provided, threaded on the shaft 205, a spring tension adjusting nut or knob 207. Knob 207 is provided for adjusting the compression applied by the spring to the connecting strip 202. Located above the connecting strip 202 there is provided a lever member 210. The lever member 210 is provided with a downwardly extending wall member 211. At the rear end of the downwardly extending member 211 there is provided a curved surface 212. Intermediate the ends of the lever member 210, lever member 210 is pivotably coupled, as by a pin 213, to the housing 201. At its forward end, the upper surface of the lever member 210 is generally flat for receiving the heel of a ski boot for pivoting the forward end of the member 210 downwardly about the axis of the pin member 213. At the opposite end of the lever member 210 there is provided a beveled hole 214 for receiving the tip of a ski pole or the like for pivoting the lever member 210 in the opposite direction about the axis of the pin 213.

Figure 9:
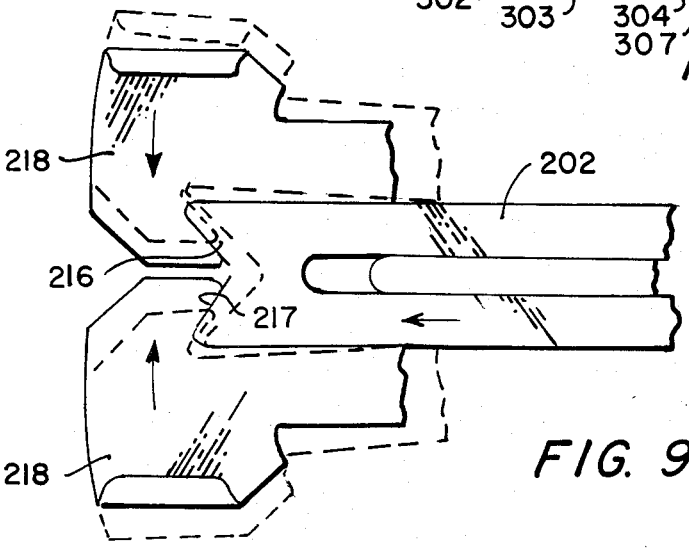
FIG. 9 is a partial plan view of an alternative connecting member and side clamping members.

Referring to FIG. 9, the forward end of the connecting member 202 is providedwith a V-shaped surface 217 for slidable engagement with corresponding V-shaped surfaces 216 of a pair of side clamping members 218.

In opperation, as the connecting member 202 is moved rearwardly, the clamping members 218 are free to pivot outwardly therefrom for opening the clamping members. When the connecting member 202 is moved to the left in a forward direction, the engagement of the mating surfaces 216 and 217 causes the clamping members 218 to be pulled inwardly to a closed position. With those exceptions, the clamping members 218 and connecting member 202 are otherwise substantially identical to the clamping members 5 and 6 and connecting member 40 of the embodiment of FIGS. 1–4 and the clamping members and connecting member 102 of the embodiment of FIGS. 5 and 6.

Figure 8:
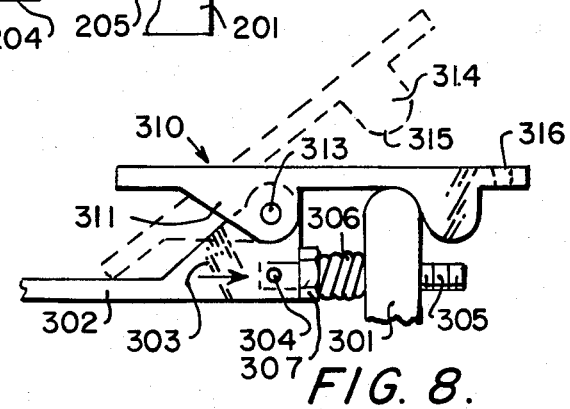
FIG. 8 is a schematic representation of still another embodiment of the present invention.

In use, to open the clamping members, a ski pole or the like is inserted in the hole 214 of the lever member 210 for rotating the lever member 210 about the axis of the pin 213. As the curved rear surface of the downwardly extending wall member 211 slidably engages the forward surface of the upstanding member 203 of the connecting member 202. The connecting member 202 is forced rearwardly against the spring force of the spring 206. As seen in FIG. 8, as the connecting member 202 is moved rearwardly in the direction of the arrow, the clamping members 218 are free to pivot outwardly in a direction substantially perpendicular to the housing 201.

To step into the binding, with the clamping members in an open position, the heel of a ski boot is brought to bear against the upper surface of the forward end of the lever member 210. As the forward end of the lever member 210 is forced downwardly about the axis of the pin 213, the lever member 210 is caused to slide from contact with the connecting member 202. As the lever member 210 slides from the connecting member 202, the spring 206 forces the connecting member 202 forwardly. The forward movement of the connecting member 202 causes the clamping members 218 to be urged inwardly to a closed position.

Referring to FIG. 8, there is provided in another embodiment of the present invention, a housing 301. Forward of the housing 301, there is provided a connecting member 302 having an upstanding wall member depending therefrom 303. Connected to the upstanding member 303, as by a pin 304, there is provided a rod member 305. Coaxial with the rod member 305 there is provided a springmember 306. The spring member 306 is mounted between the rear of the upstanding wall 303 of the connecting member 302 and the interior wall of the housing 301. Threadably coupled to the rear end of the rod 305 is a spring-adjusting knob 307. The knob 307 is provided for adjusting the tension applied to the spring 306. Located above the connecting member 302 there is provided a lever member 310. Downwardly depending from the lever member 310 there is provided a wall member 311 for pivotably connecting lever member 310 to the upstanding wall member 303 of the connecting member 302 as by a pin 313.

Rearward of the downwardly depending wall member 311, there is provided a downwardly depending wall member 314. The wall member 314 has a forward curved surface 315 for slidably engaging a corresponding surface on the rear of the housing 301. Rearwardly of the downwardly depending wall member 314 there is provided in the lever member 310 a beveled hole 316 for receiving the tip of a ski pole or the like.

At its forward end, the connecting member 302 is identical to the forward end of the connecting member 202, described above with respect to FIG. 9 and cooperates with the corresponding pair of side-clamping members, as described above with respect to the embodiment of FIG. 7.

To move the connecting member 302 rearwardly, and open the side-clamping members coupled thereto, a ski pole or the like is inserted in the hole 316 provided therefor at the rear of the lever member 310. As the rear of the lever member 310 is pivoted downwardly about the axis of the pin 313, the forward edge 315 of the downwardly depending member 314 slidably engages the rear surface of the housing 301. As the surface 315 engages the surface of the housing 301, the connecting member 302 is moved rearwardly against the forces of the spring 306, opening the clamping members.

To close the clamping members, the reverse procedure is employed. The heel of the ski boot is brought to bear against the upper surface of the forward end of the lever member 310. As the heel bears down on the forward end of the lever member 310, the lever member is pivoted about the axis of the pin 313. As the lever member 310 is pivoted about the axis of the pin 313, the downwardly depending member 314 slides from the housing 301. When the downwardly depending member 314 clears the housing 301, the connecting member 302 is moved forwardly by the force of the spring 306. The forward movement of the connecting member 302 causes the forward end of the connecting member 302 to engage and pull together the side clamping members coupled thereto, as described above with respect to the embodiment of FIG. 7.

While several embodiments of the present invention are described, still other changes will occur to those skilled in the art, which can be made without departing from the spirit and scope of the present invention. For example, instead of causing the side clamping members to move outwardly to open the side clamping members and inwardly to close the side clamping members relative to a plate inserted therebetween, it is possible, by application of the principles described herein, to modify the side clamping members to move outwardly to clamp against corresponding fixed elements such as disclosed in FIGS. 1–6 of applicant's U.S. Pat. No. 3,891,227, issued June 24, 1975.

For the foregoing reasons, it is intended that the scope of the present invention be not limited to the embodiments described and suggested herein but rather be determined by the claims hereafter provided and their equivalents.

What is claimed is:

1. In a ski binding having a housing, a clamping member movably mounted in said housing for movement relative to said housing between a clamp-open and a clamp-closed position and means for applying a clamping force to said clamping member for releasably securing a ski boot to a ski rearward of the toe and forward of the rear of the heel of the ski boot, an improvement for opening and closing said clamping member comprising:

a lever member of one-piece construction spaced from and independent of said clamping member having a first and a second end movable about an axis intermediate said ends between a clamp-open and a clamp-closed position, said lever member being coupled to said clamping force applying means;

means on the lever member and engageable by a ski pole for allowing said lever member to be moved to its clamp-open position against said clamping force in response to a force applied to said first end thereof by said ski pole to allow said clamping member to move to its open position; means for frictionally holding said lever member in its open position against said clamping force when the force applied by the ski pole to said first end of said lever member is removed therefrom; and means for moving said lever member to its clamp-closed position in response to applied pressure brought to bear on said second end thereof for releasing said lever member from said holding means when said ski boot is in skiing position to allow said clamping member to close with said clamping force.

2. A binding according to claim 1, wherein said means for holding said lever member in its clamp-open position comprises a surface on said lever member which coacts with a facing surface on said housing in such a manner that said lever member is restrained from moving relative to said housing until a force is applied to said lever member to move it to its clamp-closed position.

3. A binding according to claim 1, wherein said means for moving said lever member to its clamp-closed position comprises a boot-receiving part of said lever member for receiving the sole of a ski boot being inserted in said binding.

4. In a ski binding having a housing, a clamping member movably mounted on said housing at one side thereof for lateral movement relative to said housing between a clamp-open position and a clamp-closed position and means for applying a clamping force to said clamping member for releasably securing a ski boot to a ski rearward of the toe and forward of the rear of the heel of the ski boot, an improvement for opening and closing said clamping member comprising:

a lever member of one-piece construction spaced from and independent of said clamping member, said lever member having a first and a second end and being movable about an axis therethrough intermediate said ends from a clamp-open to a clamp-closed position and return, said lever member being movable to its clamp-open position against said clamping force in response to a force applied to said first end thereof to permit movement of said clamping member to its open position; and means for holding said lever member in its open position against said clamping force when the force applied to said first end of said lever member is removed therefrom, including a surface means on said lever member for engaging a facing surface on said housing in a manner to cause said lever member to be restrained from moving relative to said housing until the force is applied to said lever member to move it to its clamp-closed position;

said lever member being movable to its clamp-closed position in response to downwardly applied pressure brought to bear on said second end thereof to permit release of said lever member from said holding means when said ski boot is in skiing position and to allow said clamping member to move to said clamp-closed position under the influence of said clamping force.

5. A binding according to claim 4, wherein said lever member includes a boot-receiving part at said second end for engagement by the sole of a ski boot being inserted in said binding.

6. In a ski binding having a housing, a clamping member movably mounted in said housing for movement relative to said housing between a clamp-open position and a clamp-closed position and means for applying a clamping force to said clamping member for releasably securing a ski boot to a ski rearward of the toe and forward of the rear of the heel of the ski boot, an improvement for opening and closing said clamping member comprising:

a connecting member for engaging said clamping member;

a lever member spaced from and independent of said clamping member having a first and a second end movable about an axis intermediate said ends between a clamp-open and a clamp-closed position;

means for movably connecting said lever member to said connecting member;

means depending from said lever member for slidably engaging in said housing and for moving said lever member and said connecting member relative thereto against said clamping force in a first direction in response to a force applied to said first end thereof to allow said clamping member to move to its open position;

means for holding said lever member in its open position against said clamping force when the force applied to said first end of said lever member is removed therefrom; and means for moving said lever member out of contact with said housing in a second direction to its clamp-closed position in response to applied pressure brought to bear on said second end thereof for releasing said lever member from said holding means when said ski boot is in skiing position to allow said clamping member to close with said clamping force.

7. An improvement according to claim 6, comprising a first means located at one end of said lever member for facilitating the movement of said lever member in said first direction to open said side clamping member, and a second means located at the opposite end of said lever member for facilitating the movement of said lever member in said second direction to close said clamping member.

8. An improvement according to claim 7, wherein said first means comprises means for receiving the tip of a ski pole and said second means comprises means for receiving the heel of a ski boot.

9. An improvement according to claim 8, wherein said ski pole tip receiving means comprises a hole and said heel receiving means comprises a portion of the upper surface of the forward end of said lever member.

10. In a ski binding having a housing, a clamping member movably mounted in said housing for movement relative to said housing between a clamp-open position and a clamp-closed position and means for applying a clamping force to said clamping member for releasably securing a ski boot to a ski rearward of the toe and forward of the rear of the heel of the ski boot, an improvement for opening and closing said clamping member comprising:

a lever member spaced from and independent of said clamping member having a first and a second end movable about an axis intermediate said ends between a clamp-open and a clamp-closed position, said lever member being coupled to said clamping force applying means;

means for moving said lever member to its clamp-open position against said clamping force in response to a force applied to said first end thereof to allow said clamping member to move to its open position;

means for holding said lever member in its open position against said clamping force when the force applied to said first end of said lever member is removed therefrom;

means for moving said lever member to its clamp-closed position in response to applied pressure brought to bear on said second end thereof for releasing said lever member from said holding means when said ski boot is in skiing position to allow said clamping member to close with said clamping force; and a pair of heel-step members at the rear of the housing for supporting the heel of a boot and for preventing engagement of said ski boot by said lever member as said clamping member starts to move to its open position.

11. In a ski binding having a housing, a clamping member movably mounted on said housing at one side thereof for lateral movement relative to said housing between a clamp-open position and a clamp-closed position and means for applying a clamping force to said clamping member for releasably securing a ski boot to a ski rearward of the toe and forward of the rear of the heel of the ski boot, an improvement for opening and closing said clamping member comprising:

a lever member spaced from and independent of said clamping member, said lever member having a first and a second end and being movable about an axis therethrough intermediate said ends from a clamp-open and a clamp-closed position and return, said lever member being movable to its clamp-open position against said clamping force in response to a force applied to said first end thereof to permit movement of said clamping member to its open position; and means for holding said lever member in its open position against said clamping force when the force applied to said first end of said lever member is removed therefrom, said lever member being movable to its clamp-closed position in response to downwardly applied pressure brought to bear on said second end thereof to permit release of said lever member from said holding means when said ski boot is in skiing position and to allow said clamping member to move to said clamp-closed position under the influence of said clamping force; and a pair of heel-step members on the rear of the housing providing a clearance between the heel of said ski boot and the ski for preventing engagement of said ski boot by said lever member as said clamping member starts to be moved to its open position.

* * * * *